US008059840B2

(12) United States Patent
Chen

(10) Patent No.: US 8,059,840 B2
(45) Date of Patent: Nov. 15, 2011

(54) SYSTEM AND METHOD FOR LOCATING SOUND SOURCES

(75) Inventor: Meng-Chun Chen, Tu-Cheng (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 990 days.

(21) Appl. No.: 11/967,106

(22) Filed: Dec. 29, 2007

(65) Prior Publication Data

US 2009/0074202 A1 Mar. 19, 2009

(30) Foreign Application Priority Data

Sep. 17, 2007 (CN) ..... 2007 1 0201745

(51) Int. Cl.
*H04R 3/00* (2006.01)
*H04R 1/02* (2006.01)

(52) U.S. Cl. ..... 381/122; 381/91; 381/92; 381/95

(58) Field of Classification Search ..... 381/26, 381/91–92, 95, 122
See application file for complete search history.

(56) References Cited

U.S. PATENT DOCUMENTS 6,707,910 B1 * 3/2004 Valve et al. ..... 379/388.06
7,084,801 B2 * 8/2006 Balan et al. ..... 341/155
2005/0078833 A1 4/2005 Hess

* cited by examiner

*Primary Examiner* — Theresa T Doan
(74) *Attorney, Agent, or Firm* — Altis Law Group, Inc.

(57) ABSTRACT

An exemplary method for locating sound sources is disclosed. The method includes the steps of: loading a sound source location program into a handheld device; activating the sound source location program; calculating a total voltage representing sound waves received by a microphone array via a waveform computation algorithm; calculating energy intensities of the total voltage according to the total voltage; and selecting a maximum energy intensity from the calculated energy intensities, and determining the location of the maximum energy intensity, the location of the maximum energy intensity is the location of the sound source. A related system is also disclosed.

8 Claims, 3 Drawing Sheets

SYSTEM AND METHOD FOR LOCATING SOUND SOURCES

BACKGROUND OF THE INVENTION

1. Field of the Invention

The present invention generally relates to a system and method for locating sound sources.

2. Description of Related Art

Currently, sound source localization, in handheld devices, is enhanced by microphone arrays. Although, a microphone array in a handheld device is shown as one mouthpiece, in actuality, a number of microphones (sound receptors) are spaced apart and under the mouthpiece.

However, if the underlying microphones, of the mouthpiece, are too close together, the microphones may not be able to localize sound waves. Thus the microphones may pick up and enhanced background noise. That is, when sound waves are emitted from a plurality of directions simultaneously, the incoming locations of the sound waves from the respective sources cannot be determined. For example, when the mobile phone is being used in a crowded room, there are many voices from different persons, and the accurate locations of the pertinent voice cannot be determined.

Therefore, what is needed is a system and method for accurately locating sound sources so as to improve the receptive quality of sound waves.

SUMMARY OF THE INVENTION

A system for location sound sources is provided. The system comprises a handheld device that includes a microphone array, wherein the handheld device further comprises: a sound source location program configured for calculating a total voltage representing sound waves received by the microphone array from an angle via a waveform computation algorithm, the angle between each sound wave with each microphone in the microphone array seemed as same; calculating multiple energy intensities of the total voltage; selecting a maximum energy intensity from the calculated energy intensities; and determining the location of the maximum energy intensity, the location of the maximum energy intensity is the location of the sound.

Another embodiment of a method for locating sound sources is provided. The method comprises the steps of: loading a sound source location program into a handheld device, which comprises a microphone array; activating the sound source location program when the handheld device is in a hand free mode or in a telephone conference; calculating a total voltage representing sound waves received by the microphone array from an angle via a waveform computation algorithm, the angle between each sound wave with each microphone in the microphone array seemed as same; calculating multiple energy intensities of the angle according to the total voltage; selecting a maximum energy intensity from the calculated energy intensities; and determining the location of the maximum energy intensity, the location of the maximum energy intensity is the location of the sound source.

Other objects, advantages and novel features of the embodiments will be drawn from the following detailed description together with the attached drawings.

DETAILED DESCRIPTION OF THE INVENTION

Figure 1:
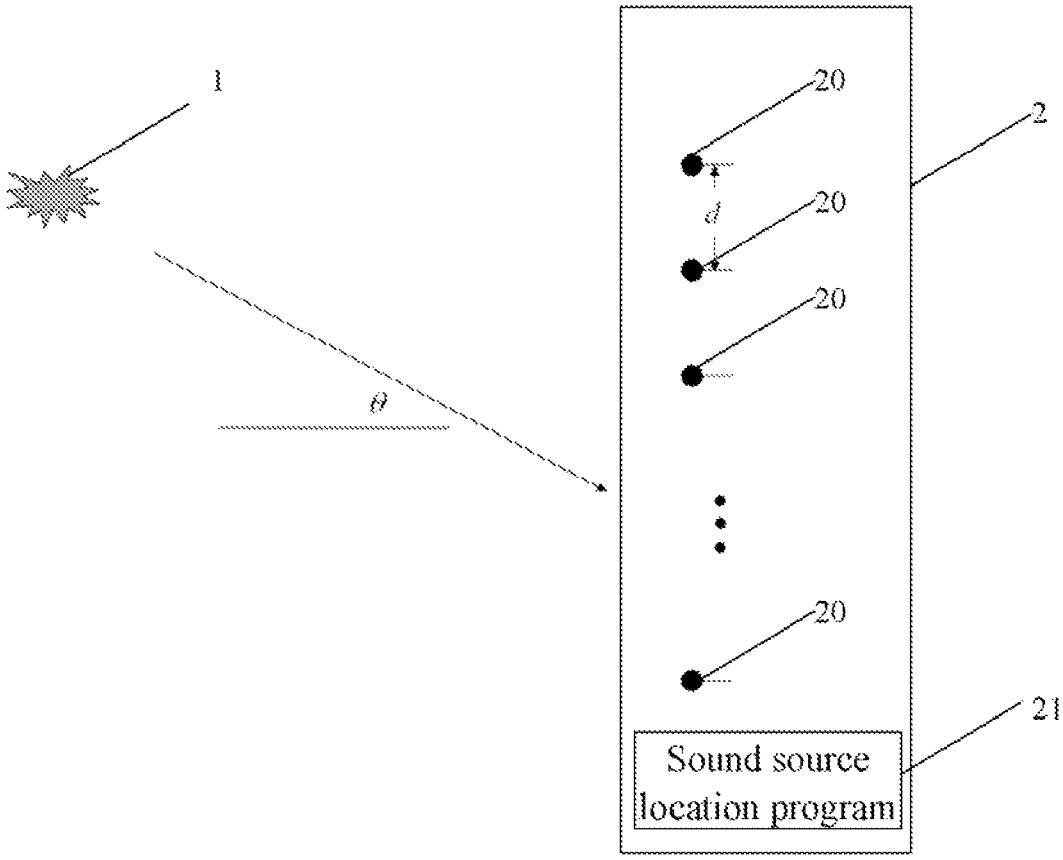
FIG. 1 is a schematic diagram of a hardware configuration of a system for locating sound sources in accordance with a preferred embodiment.

FIG. 1 is a schematic diagram of a hardware configuration of a system for locating sound sources (hereinafter, "the system") in accordance with a preferred embodiment. The system includes a handheld device 2. The handheld device 2 may be, but not limited to, a mobile phone, a PDA (Personal Digital Assistant), or a MP3. The handheld device 2 includes a microphone array 20 that comprises at least one microphone. The distance between two adjacent microphones in the microphone array 20 is labeled as "d". A sound source 1 (the sound source may be variable) sends out sound waves to the microphone array 20. The handheld device 2 has a sound source location program 21 configured for calculating a total voltage V(θ) that represents sound waves received by the microphone array 20 from a θ angle formed by the sound waves and the microphone array 20 via a waveform computation algorithm. The θ is a variable of an angle of the sound waves with a horizontal line. Because the distance d between two adjacent microphones are very small, so the θ angle between each sound wave with each microphone in the microphone array 20 seemed as same. The waveform computation algorithm is expressed as below:

$$V(\theta) = \sum_{m=0}^{n-1} R_m \cos(\omega t + m\mu),$$

wherein $$\mu = \frac{2\pi d}{\lambda} \sin\theta.$$

In the waveform computation algorithm, V(θ) is the total voltage, d is the distance between two adjacent microphones in the microphone array 20, λ is a wavelength of the sound waves, n is a total number of the microphones, m is a serial number of one of the microphones, and $R_m$ is a voltage response value of the microphone having the serial number of m.

Figure 2:
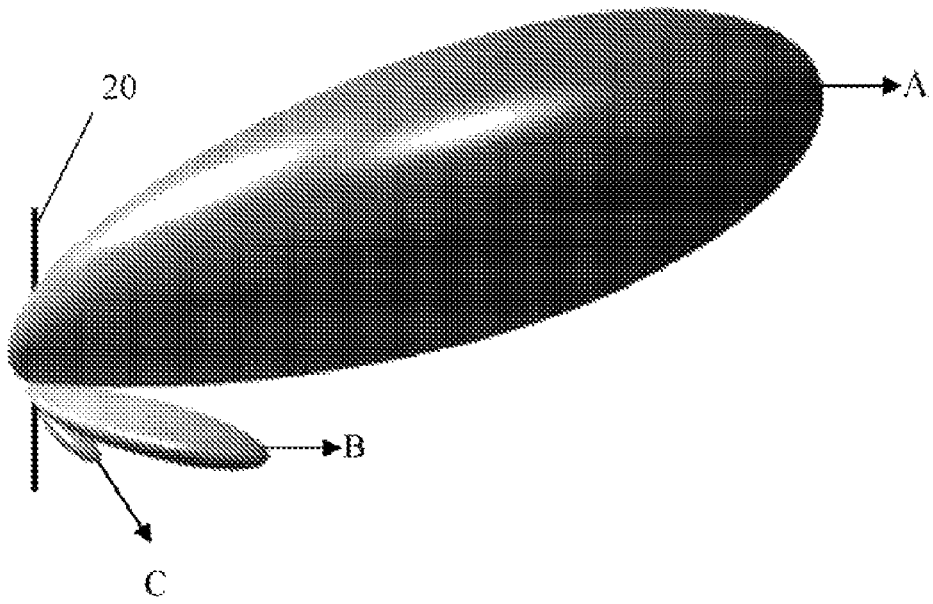
FIG. 2 is an exemplary diagram illustrating distributions of energy intensities of sound waves from a sound source of FIG. 1.

The sound source location program 21 is also configured for calculating multiple energy intensities b(θ) of the total voltage V(θ) from the θ angle of the sound waves according to the formula of:

$$b(\theta) = \left(\frac{V(\theta)}{n}\right)^2,$$

wherein b(θ) is an energy intensity as shown in FIG. 2. As θ is a variable of the angle between the sound source 1 with a horizontal line, b(θ) is changed according to the change of θ.

The sound source location program 21 is further configured for selecting a maximum energy intensity from the calculated energy intensities b(θ), for determining the location of the maximum energy intensity, this maximum energy intensity location being the location of the sound source, and for improving the sensitivity of the microphone array 20 towards the location of the sound source in order to improve a receptive quality of the microphone array 20.

FIG. 2 is an exemplary diagram illustrating distributions of the energy intensities b(θ) of the total voltage representing the sound waves from the sound source 1. Three locations "A", "B" and "C" are shown in FIG. 2, the location "A" has maximum energy intensity, thus the location "A" is determined as the location of the sound source 1.

Figure 3:
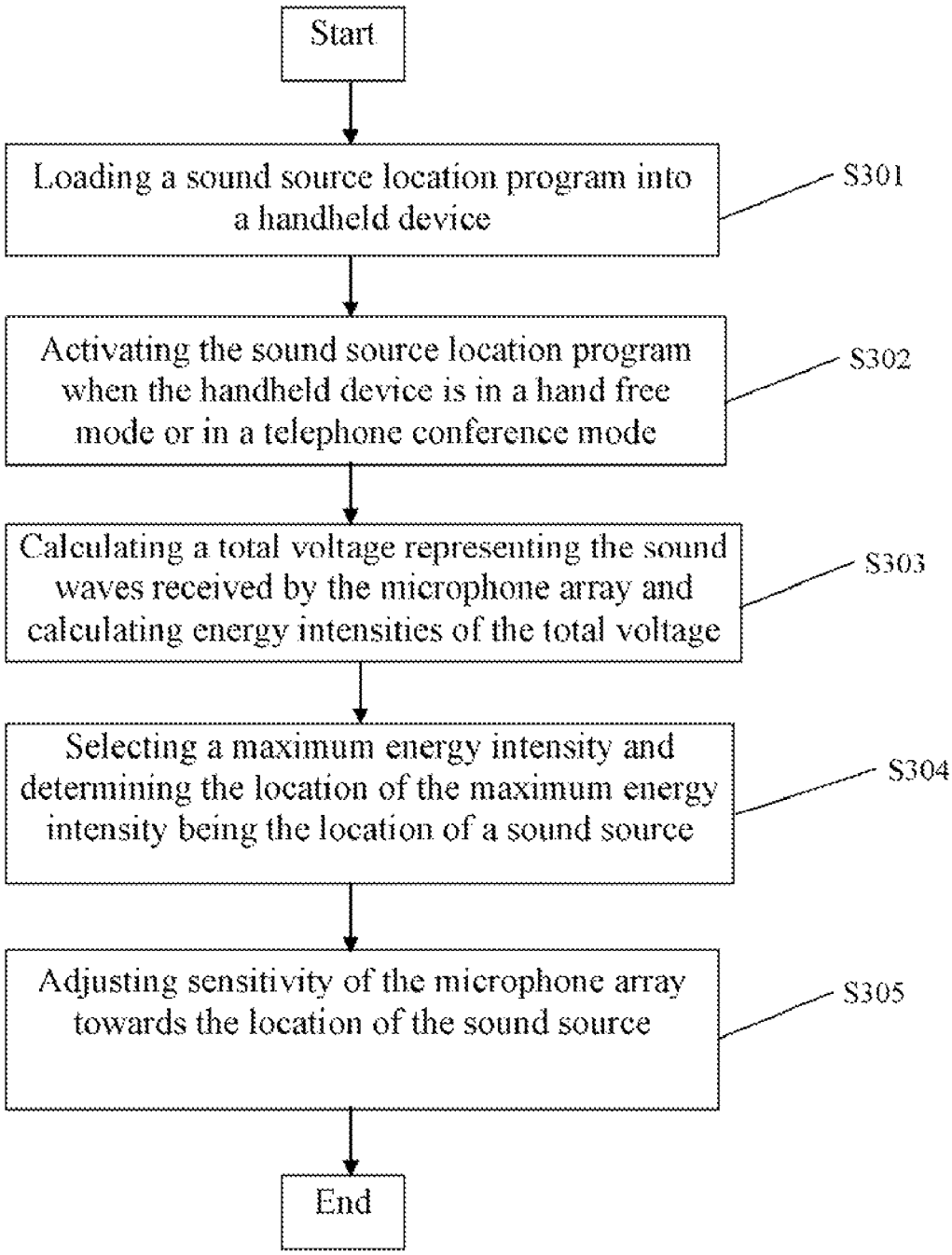
FIG. 3 is a flow chart of a method for locating sound sources in accordance with the preferred embodiment.

FIG. 3 is a flow chart of a method for locating sound sources in accordance with the preferred embodiment. In step S301, a user loads the sound source location program 21 into the handheld device 2. The handheld device 2 may be, but not limited to, a mobile phone, a PDA or a MP3. In step S302, the handheld device 2 activates the sound source location program 21 when the handheld device 2 is in a hand free mode or in a telephone conference. In step S303, the sound source location program 21 calculates the total voltage V(θ) of the sound waves received by the microphone array 20 from the θ angle formed by the sound waves and the microphone array 20 via the waveform computation algorithm, and calculates multiple energy intensities of the total voltage V(θ) according to the formula of:

$$b(\theta) = \left(\frac{V(\theta)}{n}\right)^2.$$

The θ angle between each sound wave with each microphone in the microphone array seemed as same. The waveform computation algorithm is expressed as:

$$V(\theta) = \sum_{m=0}^{n-1} R_m$$

cos(ωt+mμ), wherein $$\mu = \frac{2\pi d}{\lambda}\sin\theta.$$

In step S304, the sound source location program 21 selects a maximum energy intensity from the calculated energy intensities b(θ), and determines the location of the maximum energy intensity, this maximum energy intensity location being the location of the sound source 1. In step S305, the sound source location program 21 adjusts the sensitivity of the microphone array 20 towards the location of the sound source 1 in order to improve the receptive quality of the microphone array 20 from the sound source 1.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. A computer-based method for locating sound sources, the method comprising the steps of:

loading a sound source location program into a handheld device, which comprises a microphone array;

activating the sound source location program;

calculating a total voltage representing sound waves received by the microphone array from an angle formed by the sound waves and the microphone array via a waveform computation algorithm, the angle between each sound wave with each microphone in the microphone array seemed as same;

calculating multiple energy intensities of the total voltage;

selecting a maximum energy intensity from the calculated energy intensities; and determining the location of the maximum energy intensity, the locating of the maximum energy intensity being the location of the sound source.

2. The method according to claim 1, further comprising the step of:

adjusting sensitivity of the microphone array towards the location of the sound source.

3. The method according to claim 1, wherein the waveform computation algorithm is expressed as:

$$V(\theta) = \sum_{m=0}^{n-1} R_m \cos(\omega t + m\mu),\ \mu = \frac{2\pi d}{\lambda}\sin\theta;$$

V(θ) is the total voltage, d is distance between two adjacent microphones in the microphone array, λ is wavelength of the sound waves, n is total numbers of the microphones, m is a serial number of one of the microphones, and $R_m$ is a voltage response value of the microphone having the serial number of m.

4. The method according to claim 3, wherein the sound source location program calculates the energy intensities according to the formula of:

$$b(\theta) = \left(\frac{V(\theta)}{n}\right)^2,$$

b(θ) is the energy intensity from an angle of θ.

5. A handheld device for locating sound sources, comprising:

a microphone array; and a sound source location program configured for:

calculating a total voltage representing sound waves received by the microphone array from an angle formed by the sound waves and the microphone array via a waveform computation algorithm, the angle between each sound wave and each microphone in the microphone array seemed as same;

calculating multiple energy intensities of the total voltage;

selecting a maximum energy intensity from the calculated energy intensities; and determining the location of the maximum energy intensity, this maximum energy intensity location being the location of the sound source.

6. The handheld device of claim 5, wherein the sound source location program is further configured for adjusting sensitivity of the microphone array towards the location of the sound source.

7. The handheld device of claim 5, wherein the waveform computation algorithm is expressed as:

$$V(\theta) = \sum_{m=0}^{n-1} R_m \cos(\omega t + m\mu),\ \mu = \frac{2\pi d}{\lambda}\sin\theta;$$

V(θ) is the total voltage, d is distance between two adjacent microphones in the microphone array, λ is wavelength of the sound waves, n is total numbers of the microphones, m is a serial number of one of the microphones, and $R_m$ is a voltage response value of the microphone having the serial number of m.

8. The handheld device of claim 5, wherein the sound source location program calculates the energy intensities according to the formula of:

$$b(\theta) = \left(\frac{V(\theta)}{n}\right)^2,$$

b(θ) is the energy intensity from an angle of θ.

* * * * *